US009974120B2

(12) United States Patent
Almolda Fandos et al.

(10) Patent No.: US 9,974,120 B2
(45) Date of Patent: May 15, 2018

(54) COOKTOP, HOUSEHOLD APPLIANCE COMPRISING A COOKTOP, METHOD FOR ASSEMBLING A COOKTOP AND METHOD FOR INSTALLING A COOKTOP

(75) Inventors: Manuel Almolda Fandos, Zaragoza (ES); Alfonso Lorente Perez, Zaragoza (ES); David Ortiz Sainz, Pinseque (ES); Carmelo Pina Gadea, Zaragoza (ES)

(73) Assignee: BSH Hausgeräte GmbH, Munich (DE)

( * ) Notice: Subject to any disclaimer, the term of this patent is extended or adjusted under 35 U.S.C. 154(b) by 1850 days.

(21) Appl. No.: 12/486,081

(22) Filed: Jun. 17, 2009

(65) Prior Publication Data

US 2010/0314384 A1 Dec. 16, 2010

(30) Foreign Application Priority Data

Jun. 11, 2009 (EP) ..... 09382094

(51) Int. Cl.
*H05B 6/12* (2006.01)

(52) U.S. Cl.
CPC ..... *H05B 6/1263* (2013.01); *Y10T 29/5313* (2015.01)

(58) Field of Classification Search
USPC ..... 219/439, 481, 620, 729; 126/41 R, 40, 126/50, 299 D, 299 R; 16/128 R, 135, 16/158, 181; 220/334, 335
See application file for complete search history.

(56) References Cited

U.S. PATENT DOCUMENTS

| | | | | |
|---|---|---|---|---|
| 2,229,945 | A * | 1/1941 | Uhlrig | 99/400 |
| 3,863,619 | A * | 2/1975 | Wolf | 126/200 |
| 3,878,585 | A * | 4/1975 | Morris | 16/260 |
| 2003/0094171 | A1* | 5/2003 | Harrod et al. | 126/41 R |
| 2004/0194777 | A1* | 10/2004 | Antoniello | 126/299 R |
| 2008/0017630 | A1* | 1/2008 | Fandos et al. | 219/481 |

FOREIGN PATENT DOCUMENTS

EP 0819400 A1 1/1998

OTHER PUBLICATIONS

National Search Report ES 200930629.

* cited by examiner

*Primary Examiner* — Thien S Tran

(74) *Attorney, Agent, or Firm* — Michael E. Tschupp; Andre Pallapies; Brandon G. Braun

(57) ABSTRACT

A cooktop includes a burner box, a heat shield pivotably attached to a bottom of the burner box, a lock for locking the heat shield in a transport position, wherein the heat shield is self-pivotable from the transport position to an operational position after unlocking the lock, and when in the operational position the heat shield is pivoted further from the bottom of the burner box than in the transport position.

11 Claims, 7 Drawing Sheets

COOKTOP, HOUSEHOLD APPLIANCE COMPRISING A COOKTOP, METHOD FOR ASSEMBLING A COOKTOP AND METHOD FOR INSTALLING A COOKTOP

BACKGROUND OF THE INVENTION

The invention relates to a cooktop with a burner box and a heat shield attached to a bottom of the burner box. The invention further relates to a household appliance with the cooktop and a method for assembling the cooktop as well as to a method for installing the cooktop.

Induction cooktops have to pass a temperature test as is described in the known standard UL 858. This test roughly consists in the induction cooktop being able to function over a long period with all its cooking hobs switched on. On each of the cooking hobs water is kept boiling or a metal plate is kept on a steady temperature. This temperature test is carried out by means of a special cooktop receptacle in the form of a standardized case, onto the open top surface of which the cooktop to be tested is inserted. The case emulates a cooktop receptacle of a real induction cooking appliance, e.g. an induction range or a self-contained induction cooking appliance. The test is deemed passed if no component of the induction cooktop or the case exceeds a predetermined temperature threshold.

A conventional cooktop 101 is shown in FIG. 1, wherein the cooktop 101 is fittingly inserted into a case 102 provided according to standard UL 858 for conducting a temperature test. The case 102 emulates a receptacle of a real cooking appliance. The cooktop 101 comprises, inter alia, a top surface cooking plate 103 (typically a glass plate or a glass ceramic plate) which rests on the case 102. On a lower surface 104 of the cooking plate 103, a burner box 105 is attached and sunk in the case 102. The burner box 105 accommodates a fan 107 for cooling the induction cooktop components. Also, the housing 106 comprises a cooling air inlet 108 and a warm air outlet 109. Directly under the cooking plate 103 an inductor element 110 is attached, which effects energy transfer at the individual cooking hobs of the cooking plate 103.

There is an intermediate space 112 between the burner box 105 and the case 102. This intermediate space 112 is adjacent to the cooling air inlet 108, to the warm air outlet 109 as well as to duct holes 113, 114 in the case 102, which connect the intermediate space 112 with an outer environment. The intermediate space 112 thus connects the duct holes 113, 114 with the cooling air inlet 108 and the warm air outlet 109.

For cooling the cooktop 101 during operation to prevent overheating, the fan 107 aspirates cooling air K through the cooling air inlet 108 out of the intermediate space 112. The cooling air K then heats up by flowing across the components of the cooktop 101 to be cooled. The cooling air is blown out as a warm exhaust air W through the warm air outlet 109 into the intermediate space 112. In practice, only a minor part of the warm exhaust air W would be emitted through the adjacent duct hole 114, a residual part of the warm exhaust air W disperses in the intermediate space 112 and may even reach the cooling air inlet 108. Via the cooling air inlet 108 the warm exhaust air W would again be aspirated by the fan 107. This substantially reduces the cooling effect and even considerably increases the possibility to fail the temperature test according to UL 858.

In order to avoid such a "thermal shortcut," a rigid heat shield 115 is attached to the lower surface of the burner box 105 between the cooling air inlet 108 and the warm air outlet 109 across the width of the intermediate space 112 (here in a direction perpendicular to the plane of view) and extending down perpendicularly from the burner box 105. Because of the heat shield 115, the intermediate space 112 is divided into two sub spaces 116 and 117. The first sub space 116 abuts on the duct hole 113 and the cooling air inlet 108 and provides an air channel for the cooling air K via these elements 113, 108. The second sub space 117 abuts on the warm air outlet 109 and the duct hole 114, and serves as an air channel for the warm exhaust air W via these elements 109, 114. The heat shield 115 prevents warm exhaust air W leaving the warm air outlet 109 towards the cooling air inlet 108 via said intermediate space 112. Thus the thermal shortcut is avoided.

However, this arrangement bears the disadvantage that the height of the heat shield 115, which comprises an angular profile and which is attached to the burner box 105 in a fixed and rigid manner, must be exactly adapted to a height h of the intermediate space 112. If the heat shield 115 is too low, a gap between the heat shield 115 and the case 102 is created, through which warm exhaust air W could again reach the cooling air inlet 108. If the heat shield 115 is too high, the cooking plate 103 is no longer able to fully bear on the case 102. Also, the heat shield 115 can be easily damaged during transport, e.g. deformed.

BRIEF SUMMARY OF THE INVENTION

It is an object of the invention to overcome the aforementioned deficiencies and in particular to provide an effective and easy-to-install separation between cooling air and warm exhaust air at a burner box.

According to one aspect of the invention, a cooktop includes a burner box with a heat shield attached to a bottom of the burner box. The heat shield is pivotably attached to the bottom of the burner box. Further, the heat shield is lockable in a transport position by a lock. Additionally, the heat shield is self-pivotable from the transport position after unlocking or releasing the lock. In an operational position the heat shield is pivoted or sticks out further from the bottom of the burner box than in the transport position.

In this context, the transport position is to be understood as a general first position which differs from an operating position as a general second position in that it protrudes or is pivoted less from the burner box. The transport position is in particular not only intended for use during a transport of the cooktop, but can for example denote a general condition or position which can be taken on when the cooktop is not in operation. Such a first position or transport position can for example be adopted when the heat shield is transferred form the second position or operating position back to the transport position. To this end, the heat shield can be generally transferable between the transport position and the at least one operating position, if applicable also in case of a cooktop already inserted.

The pivotable attachment enables the heat shield to protrude from the bottom of the burner box with a variable height that relates to the rotational position of the heat shield. Thus, it is possible to use the same cooktop with cases or cooktop receptacles of different heights. For installation of the cooktop, the burner box can be inserted into a cooktop receptacle and the heat shield can pivot within the intermediate space until it contacts a floor of the cooktop receptacle. This position of the heat shield then corresponds to the operating position.

The lock enables a secure and inexpensive attachment of the heat shield at the burner box and may prevent damage to the heat shield, for example during assembling, packing and/or shipment. Examples of a locking include: a screwing connection, a catch mechanism with a catch, a releasable plug-in connection, a bolt etc. For example, the screwing connection enables a particularly easily and fast releasable connection of the heat shield at the bottom of the burner box by unscrewing one or more screws.

The self-pivoting feature facilitates mounting into the cooktop receptacle, since actively pivoting the heat shield after it has been released does no longer require engaging into the cooktop receptacle. Also, the self-pivoting feature enables a substantially gapless separation between the cooling air inlet and the warm air outlet of the burner box.

Generally, the cooktop is easy to install and inexpensive to realize.

According to one embodiment, the heat shield substantially extends over an entire width of the burner box. By this, lateral gaps regarding the cooktop receptacle can be minimized for an even more effective separation of cooling air and warm exhaust air.

It is noted however that even small gaps with a minor detrimental impact may be acceptable and still provide for an advantageous overall effect as set forth herein. This would bear the advantage that the heat shield may not have to exactly fill the width below the burner box. Hence, efforts and thus costs regarding the manufacture of the heat shield can be reduced even further. To reduce a width of such a gap, a sealing may be attached to the heat shield.

According to another embodiment, the heat shield is self-pivotable under action of a gravitational force. This enables an easy build-up in terms of construction efforts.

According to a yet another embodiment, the cooktop includes a spring pushing the heat shield into the operational position. By this spring, a pivoting of the heat shield from the transport position is facilitated. Moreover, this embodiment supports a substantially gapless fitting of the heat shield in the cooktop receptacle, e.g., the heat shield may be pressed against the case by the spring substantially across the total width of the heat shield.

According to a further embodiment, the heat shield can be fitted to the burner box substantially parallel or resting against the bottom of the burner box. This position corresponds to the transport position. This embodiment is particularly easy, inexpensive and fail-safe. It is a further embodiment that the heat shield in the transport position does not or not significantly protrude from the burner box. Thus, a risk of transport damage can be reduced.

According to yet another advantageous embodiment, the heat shield is hinged in the bottom of the burner box. A hinge mechanism provides an easy to implement and reliable means for attaching and pivoting the heat shield at the burner box. In addition or as an alternative, embodiments may include a pin joint or a flexible joint.

It is a further embodiment that the bottom of the burner box comprises a slit and the heat shield includes a hinge. The hinge can be or has been inserted into the slit and subsequently the heat shield can be or has been displaced along the slit. This hinged heat shield is particularly easy to connect to the burner box and does not have to be further prepared to be pivoted. Also, the adaptations to install the hinged heat shield, i.e. the introduction of the slit and the respective forming (e.g., providing of fitting hinge elements) of the heat shield, are particularly easy to implement.

It is another embodiment that the cooktop includes a blocking member blocking a backward movement of the hinged heat shield along the slit. Hence, due to the blocking member, the hinged heat shield cannot unhinge and drop out of the bottom of the burner box.

It is yet another embodiment that the blocking member is a cover adapted to cover an opening in the bottom of the burner box, wherein, if the cover is inserted into the opening, it covers at least a part of the slit, e.g., adjacent to the respective hinge element. This allows for a mechanically simple, reliable and easy to perform blocking of the hinged heat shield.

It is one more embodiment that the cover and the adjacent hinge element include or are separated via a small play. This allows for an unhindered pivoting motion of the hinged heat shield and for a sufficiently precise positioning of the hinged heat shield.

According to another embodiment, the lock can be permanently releasable or lockable again after being released.

According to another embodiment, the heat shield is made of metal sheet. Such a heat shield is especially easy and inexpensive to produce and moreover fire resistant.

According to even another advantageous embodiment the cooktop is an induction cooktop. The movable heat shield allows the induction cooktop to pass the temperature test according to UL 858. However, the invention is not restricted to use with an induction cooktop.

According to another aspect of the invention, a household appliance includes the above cooktop inserted in a respective receptacle.

The household appliance may, for example, include an intermediate space between the burner box and the cooktop receptacle and the burner box may have a cooling air intake and a warm air outlet. The intermediate space is separable into two sub-spaces by the pivotable heat shield. A first sub-space is adjacent to the cooling air intake and a second sub-space is adjacent to the warm air outlet. The space is divided by the pivotable heat shield being in an operating position into the two sub-spaces.

According to yet another aspect of the invention, a method for assembling a cooktop with a burner box includes hinging a heat shield into a bottom of the burner box of the cooktop, installing a blocking member to prevent the heat shield from dropping out of the bottom of the burner box, and installing a lock to lock the heat shield in a transport position. This method has the advantage that the pivotable heat shield is reliably connected to the burner box, allows for secure transport, and can easily be installed within the receptacle.

According to yet another aspect of the invention, a method for installing a cooktop includes releasing the lock, and pivoting the heat shield from its transport position into its operating position, e.g., by gravitational force and/or by a spring. By this method, the cooktop can be easily installed in the receptacle.

BRIEF DESCRIPTION OF THE DRAWINGS

In the following, an exemplary embodiment is explained and illustrated schematically by means of drawings.

DETAILED DESCRIPTION OF EXEMPLARY EMBODIMENTS OF THE PRESENT INVENTION

Figure 1:
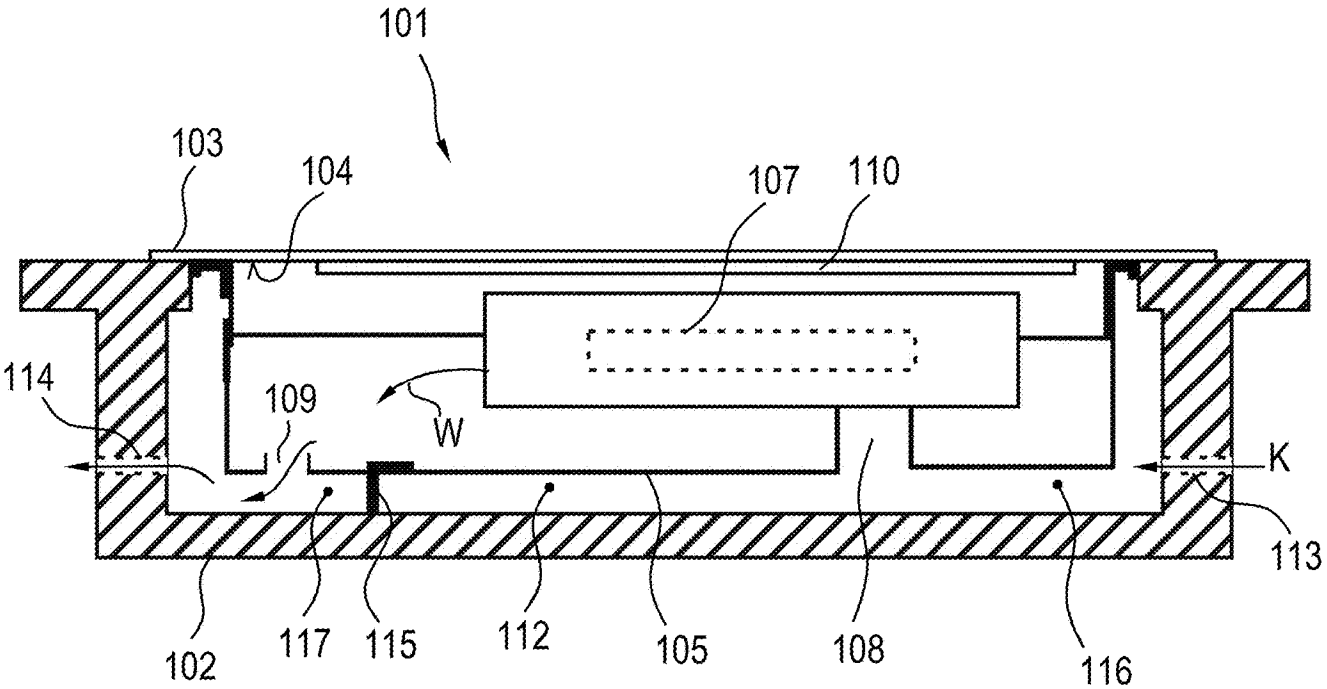
Fig.1 (Prior Art)
FIG. 1 is a sectional side view of a conventional cooktop.
Figure 2:
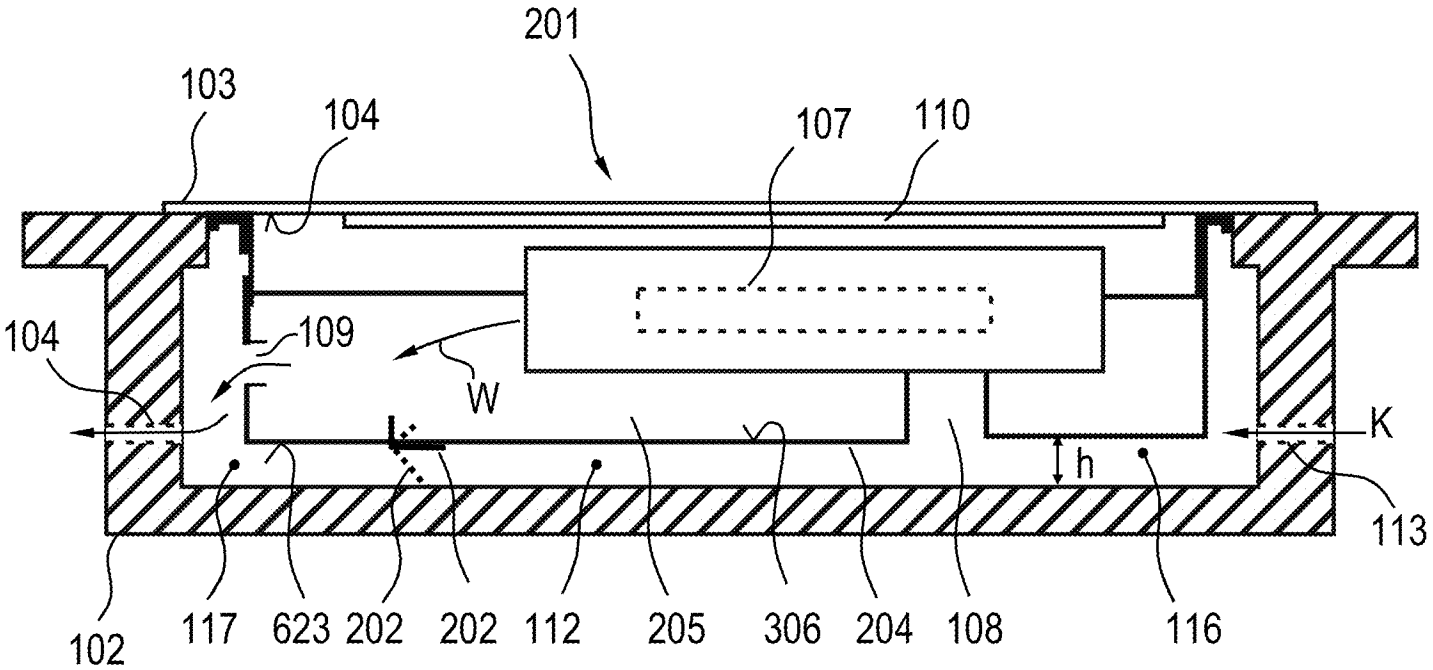
FIG. 2 is a sectional side view of a cooktop according to an exemplary embodiment of the present invention that has been fitted into a standard case.

FIG. 2 shows a cooktop 201 according to an exemplary embodiment being inserted into the case 102. The cooktop 201 includes a burner box 205 that is equipped with a hinged heat shield 202 which in turn is pivotably attached to a bottom 204 of the burner box 205. The hinged heat shield 202 can pivot from a transport position (continuous line) into an operating position (dashed line). In the operating position, the heat shield 202 is sticking out or protruding further from the burner box 205 than in the transport position.

In the transport position, the heat shield 202 may be attached to the bottom 204 of the burner box 205 in a substantially parallel or contacting way. The heat shield 202 may be secured in the transport position by a lock (shown as screw 624 in FIG. 6). In the transport position, the heat shield 202 may not significantly increase the height of the cooktop 201, so that the cooktop 201 is compact when being stored. Also, in the transport position the heat shield 202 is safe from transport damage, which could occur for example due to shocks.

To transfer the heat shield 202 from its transport position into its operating position, the lock is released. For example, a lock in form of a screw coupling can be released by being unscrewed. After releasing the lock, the heat shield 202 pivots, protrudes, flaps or rotates from the transport position into the operating position due to a gravitational force, i.e. driven by its own weight, if the cooktop 201 is in or is brought into its upright orientation. The pivoting can be supported by a spring (not shown), the spring pushing the heat shield 202 out of the transport position. The provision of the spring bears the advantage that the heat shield 202 is pushed onto the case 102 with additional pressure, thus preventing any substantial gap between the heat shield 202 and the case 102 more effectively. In the operating position, the intermediate space 112 is divided into the first sub space 116 and the second sub space 117.

Since the heat shield 202 reaches its operating position by itself in a flexible and continuous way, it is possible to use the same cooktop 201 with various cases 102 or cooktop receptacles, respectively, of different heights h of the intermediate spaces 112 up to a completely deployed operating position in which the heat shield 202 is standing vertically or almost vertically down from the bottom 204.

Hence, the approach provided advantageously suggests a particularly inexpensive-to-build, easy-to-mount and safe-to-transport means to avoid the thermal shortcut.

Figure 3:
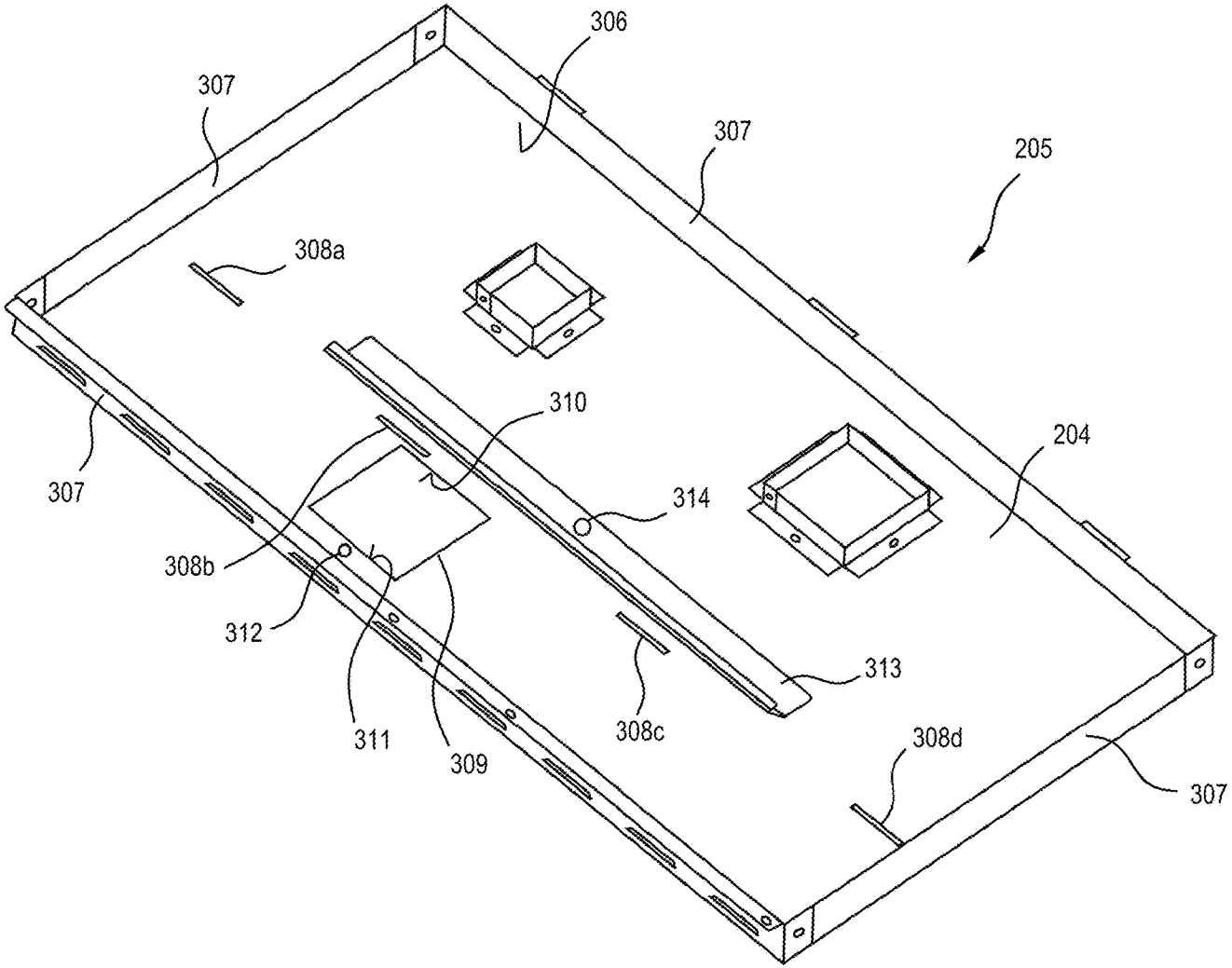
FIG. 3 is a perspective view of the bottom of the burner box from the inside, i.e. onto the upper surface of its bottom.

FIG. 3 is a perspective view of the bottom 204 of the burner box 205 from the inside, i.e. onto the upper surface 306 of the bottom 204. The bottom 204 is surrounded by a peripheral side wall 207. The bottom 204 comprises four slits 308*a* to 308*d*, arranged substantially evenly spaced in a row. In the vicinity of one of the slits 308*b* is an opening 309, one edge 310 of which lies adjacent and parallel to the slit 308 such that this edge 310 and the slit 308*b* are partially arranged next to each other. Next to the opposite edge 311, a screw opening 312 is provided in the bottom 304. Lying parallel to the slits 308*b* and 308*c*, a reinforcement plate 313 is riveted to the upper surface 306. This reinforcement plate 313 comprises a screw hole 314 that also extends through the bottom 204.

Figure 4:
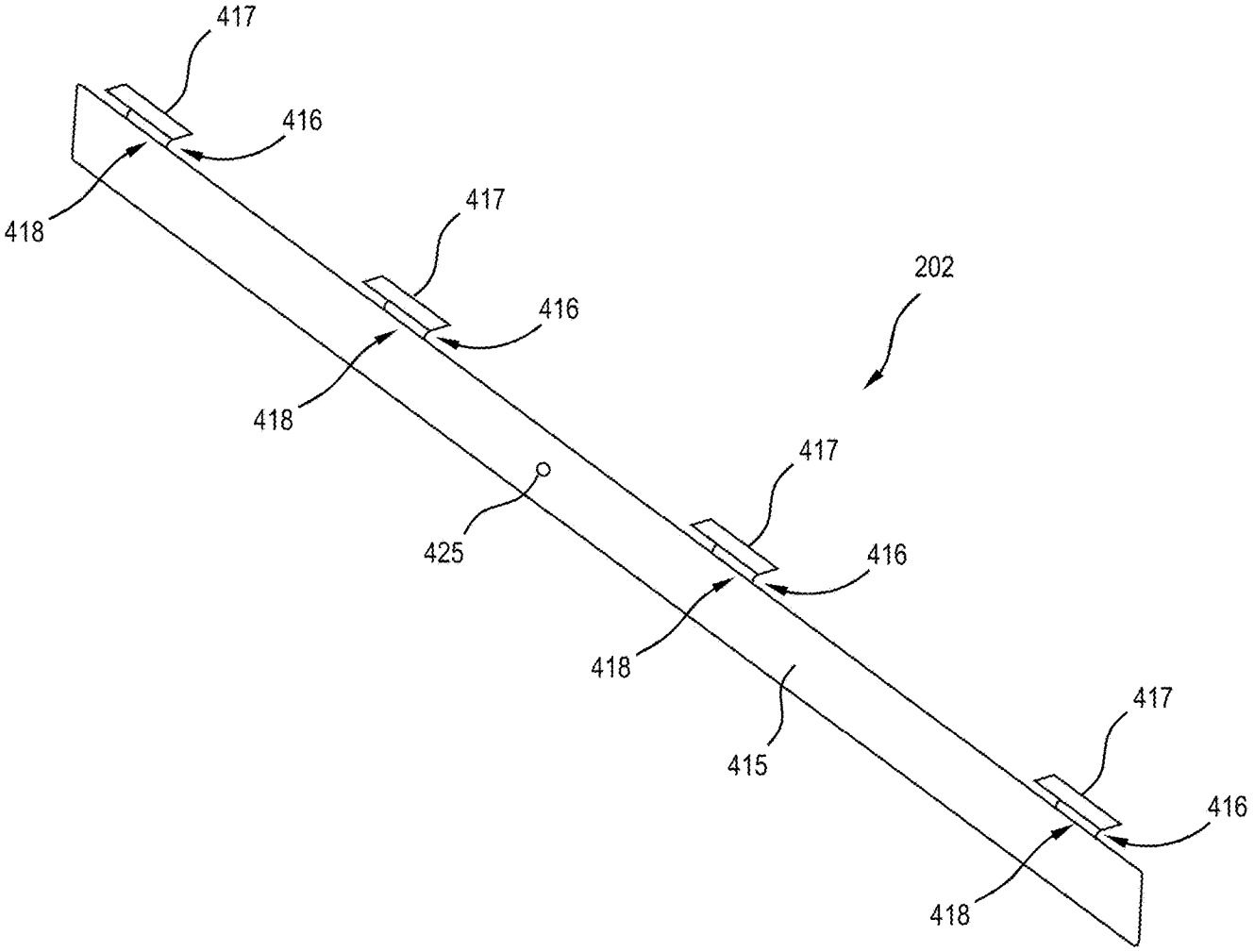
FIG. 4 is a perspective view of the heat shield.

FIG. 4 shows the heat shield 202. The heat shield 202 is provided as a substantially band-shaped and integrally formed firm metal sheet. The heat shield 202 includes a substantially rectangular divider section 415 and four hinge elements 416, which are substantially equally spaced along and extending from one edge of the divider section 415. The hinge elements 416 are basically 'L'-shaped and are composed of a longer end section 417 (the 'leg' of the 'L' shape) and a shorter connecting section 418 (the frontal 'base' of the 'L' shape). The end section 417 is thus partially supernatant with respect to the connecting section 418. The connecting section 418 connects the divider section 415 and the end section 417. The connecting section 418 is bent such that the end section 417 is angled with respect to the divider section 415. For example, the end section 417 and the divider section 415 may enclose a right angle.

The hinge elements 416 are formed and positioned such that the end sections 417 can extend into the slits 308*a* to 308*d* of the bottom 204 of the burner box 205. This insertion of the heat shield 202 into the bottom 204 can be performed from the outside or underside of the burner box 205 with the divider section lying parallel to the bottom 204. To hinge the heat shield 202 at the bottom 204, the heat shield 202 is then pushed sideways such that the bottom 204 supports the end section 417 and its supernatant part, respectively.

The heat shield 202 further comprises a screw hole 425 for being connected with the bottom 204.

Figure 5:
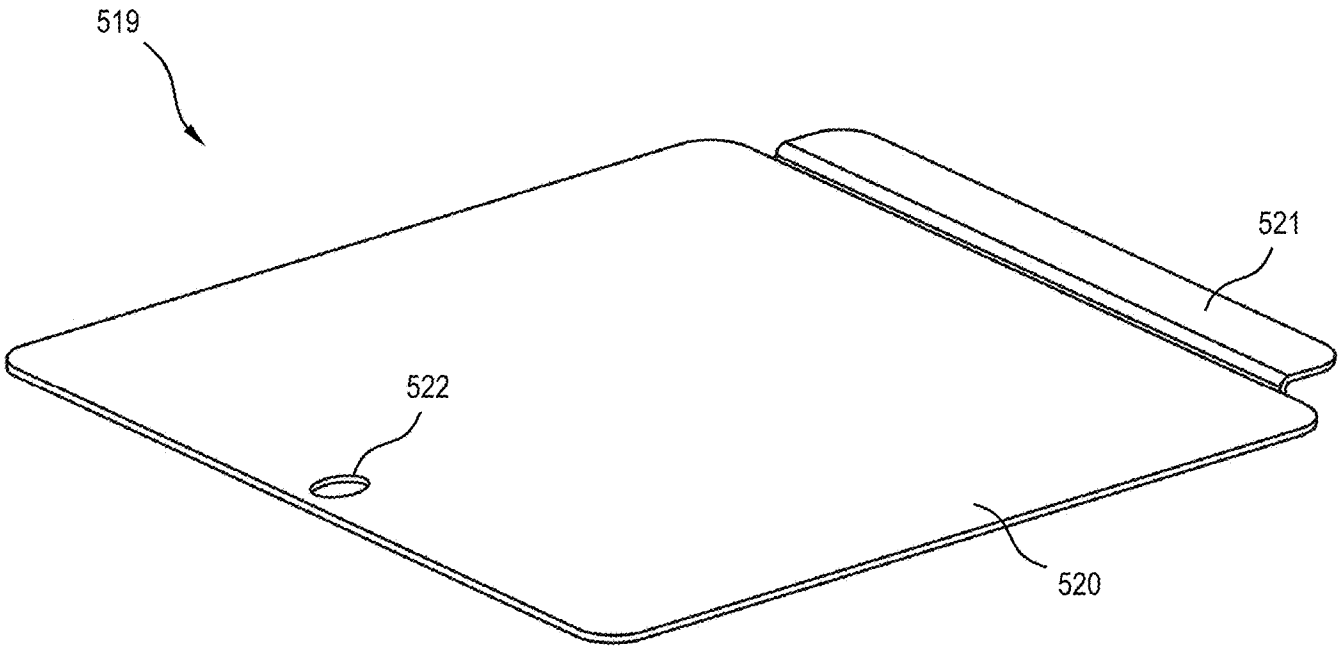
FIG. 5 is a perspective view of a blocking member.

FIG. 5 shows a blocking member 519 that prevents the hinged heat shield 202 from moving backward along the slits 308*a* to 308*d* and from dropping out of the bottom 204. The blocking member 519 is formed to cover the opening 309. Hence, the blocking member 519 includes a cover section 520, a blocking section 521, and a screw hole 522. After the hinged heat shield 202 has been inserted into the bottom 204 of the burner box 205, the blocking member 519 is placed over the opening 309 from the outside or from the underside of the burner box 205 with the blocking section 521 sticking into the inside of the bottom 204 and lying basically parallel or on the upper surface 306 of the bottom 204. The blocking section 521 engages the bottom 204 and holds the blocking member 519 in place. To do so, the blocking section 521 is formed as a step-like extension of the cover section 520. To fix the blocking member 519, a screw can be placed via the screw hole 522 and the screw hole 312 of the bottom 204, the screw holes 522 and 312 being positioned on top of each other. The blocking section 521 is formed such that it covers or overlaps a part of the slot 308*b* where the respective hinge element 416 is not present. In other words, the blocking section 521 acts as a stopper for the hinge element 416 at said slot 308*b*.

Figure 6:
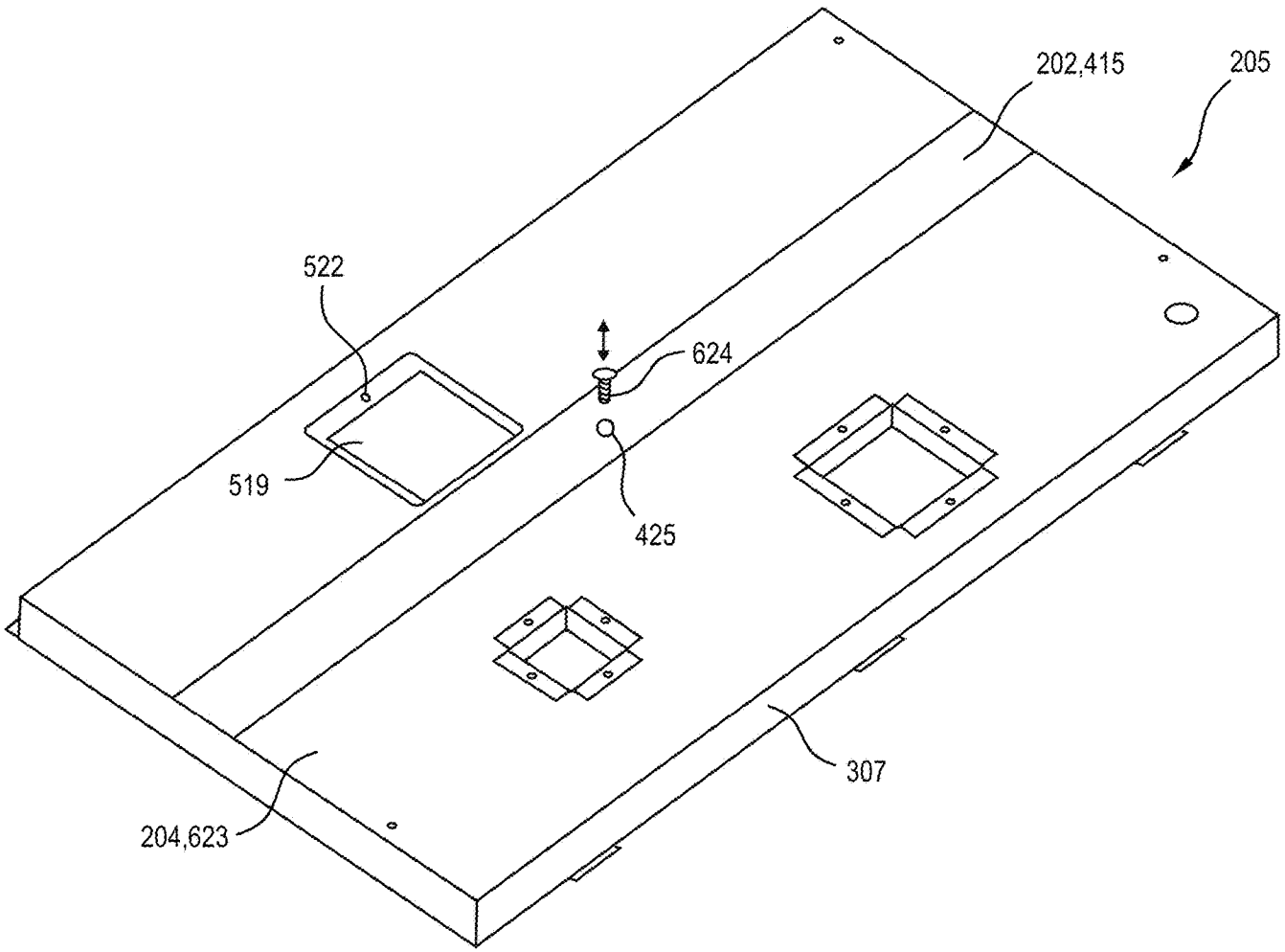
FIG. 6 is a perspective view of the bottom of the burner box from the outside with the heat shield attached in a transport position.

FIG. 6 shows an elevation view onto the outside or underside 623 of the bottom 204 of the burner box 205 with the hinged heat shield 202 attached in the transport position. In this transport position, the divider section 415 of the hinged heat shield 202 lies substantially flat on the bottom 204. To secure the hinged heat shield 202 to the bottom 204, a screw 624 is put through the screw hole 425 and the screw hole 314. At the inside of the burner box 205, the end sections 417 (not shown in FIG. 6) are sticking out in a basically perpendicular orientation with respect to the bottom 204.

Figure 7:
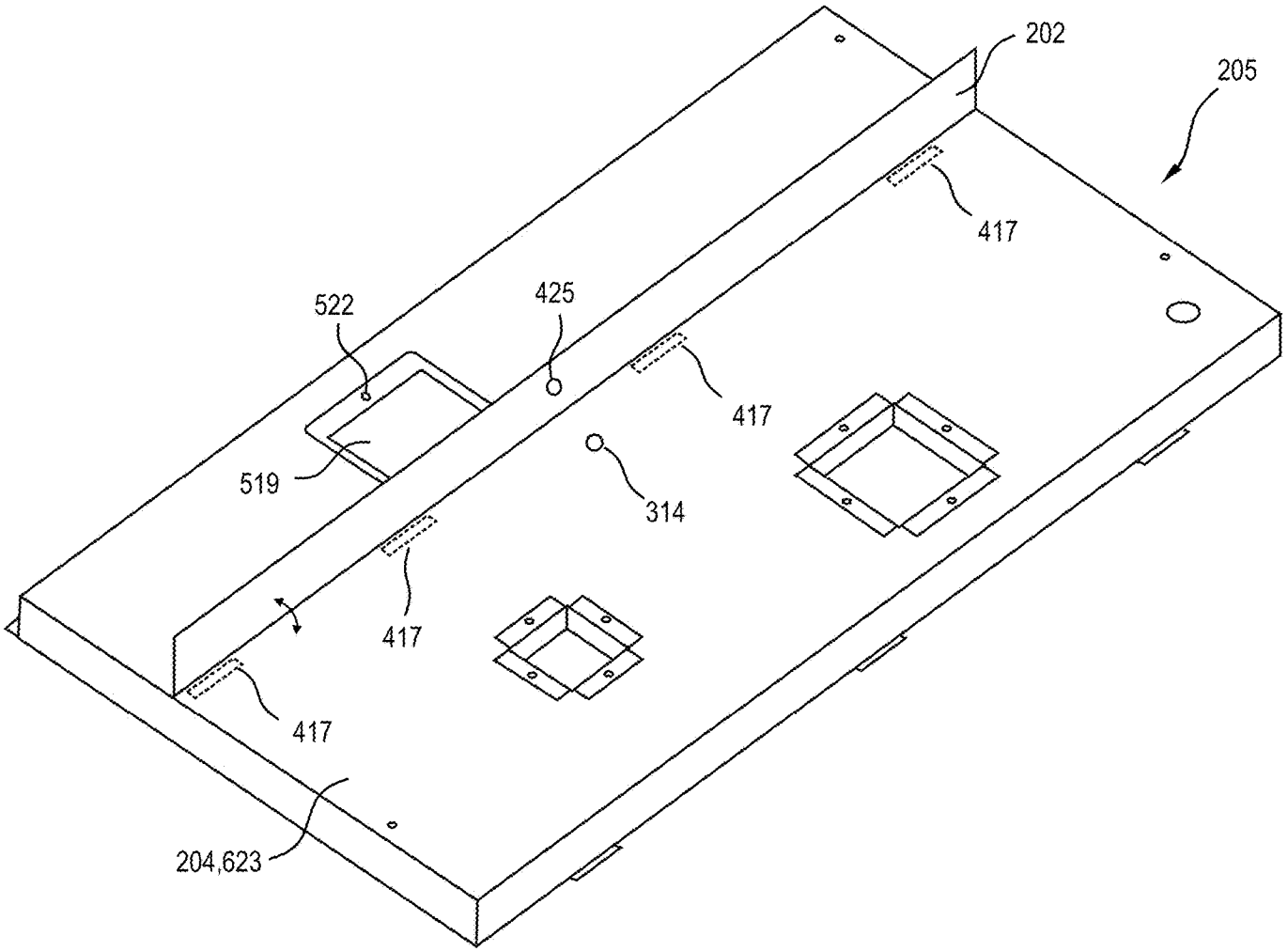
FIG. 7 is a perspective view of the bottom of the burner box from the outside with the heat shield attached in an operational position.

FIG. 7 is a perspective view of the underside 623 of the bottom 204 of the burner box 205 with the hinged heat shield 202 attached in the operational position. The hinged heat shield 202 is pivoted such that it sticks out (flaps) or protrudes from the bottom 204 in a substantially perpendicular manner, as indicated by the double arrows. At the inside of the burner box 205, the end sections 417 (sketched in dashed lines) are lying flat on the bottom 204 and thus act as stoppers preventing further rotation of the hinged heat shield 202 for easier installation. The end sections 417 may be angled less than 90° with the respect to the divider section 415 to facilitate adjustment of the operating position while fitting the cooktop 201 into the receptacle or case 102.

To transfer the hinged heat shield 202 from the transport position of FIG. 6 to the operational position of FIG. 7, the screw 624 fixing the hinged heat shield 202 can be released, as shown by the double arrows in FIG. 6. If the cooktop 201 is in its upright orientation (as seen, e.g., in FIG. 2) or is brought in its upright orientation, the hinged heat shield 202 simply pivots by virtue of its own weight.

It should be understood that the present invention is not restricted to the shown embodiments.

For example, the heat shield can attached to the bottom of the burner box by pin-joints or by a flexible joint.

Also, the heat shield can be made from a plastic material.

The invention claimed is:

1. A cooktop for receipt into a cooktop receptacle, the cooktop comprising:

a burner box;

a heat shield pivotably attached to a bottom of the burner box;

a blocking member blocking a backward movement of the heat shield along the plurality of slits, the blocking member being separate from the heat shield;

a lock for locking the heat shield in a transport position, wherein the heat shield is self-pivotable under action of a gravitational force from the transport position to an operational position after unlocking the lock and in which the heat shield contacts a floor of the cooktop receptacle, and when in the operational position the heat shield is pivoted further from the bottom of the burner box than in the transport position;

wherein the heat shield is hinged in the bottom of the burner box and the bottom of the burner box defines a plurality of slits and the heat shield comprises an L-shaped hinge inserted into the plurality of slits and the heat shield is displaced along the plurality of slits, wherein the blocking member comprises a cover that covers an opening in the bottom of the burner box and wherein the blocking member covers a part of each of the plurality of slits if the blocking member is inserted into the opening.

2. The cooktop of claim 1, wherein the heat shield comprises a metal sheet.

3. The cooktop of claim 1, characterized in that the cooktop comprises an induction cooktop.

4. A household appliance with a receptacle receiving a cooktop that comprises:

a burner box;

a heat shield pivotably attached to a bottom of the burner box;

a blocking member blocking a backward movement of the heat shield along the plurality of slits, the blocking member being separate from the heat shield;

a lock for locking the heat shield in a transport position, wherein the heat shield is self-pivotable under action of a gravitational force from the transport position to an operational position after unlocking the lock and in which the heat shield contacts a floor of the receptacle, and when in the operational position the heat shield is pivoted further from the bottom of the burner box than in the transport position;

wherein the heat shield is hinged in the bottom of the burner box and the bottom of the burner box defines a plurality of slits and the heat shield comprises an L-shaped hinge inserted into the plurality of slits and the heat shield is displaced along the plurality of slits, wherein the blocking member comprises a cover that covers an opening in the bottom of the burner box and wherein the blocking member covers a part of each of the plurality of slits if the blocking member is inserted into the opening.

5. A cooktop for receipt into a cooktop receptacle, the cooktop comprising:

a burner box having a bottom that defines a plurality of slits;

a heat shield pivotably attached to the bottom of the burner box and movable between a transport position and an operational position in which the heat shield protrudes from the bottom of the burner box and contacts a floor of the cooktop receptacle; and a blocking member which blocks a backward movement of the heat shield along the slit, the blocking member having a cover section that covers an opening in the bottom of the burner box and a blocking section which lies parallel to an upper surface of the bottom of the burner box and engages the bottom of the burner box and covers a part of each of the plurality of slits where the heat shield is not present, the blocking member being separate from the heat shield;

wherein the heat shield is hinged in the bottom of the burner box and the heat shield comprises an L-shaped hinge inserted into the plurality of slits and the heat shield is displaced along the plurality of slits.

6. The cooktop of claim 5, wherein the heat shield is self-pivotable under action of its own weight from the transport position to the operational position.

7. The cooktop of claim 5, wherein the heat shield comprises a metal sheet.

8. The cooktop of claim 5, wherein the heat shield comprises a divider section and a hinge element extending from the divider section.

9. The cooktop of claim 8, wherein the hinge element comprises an end section and a connecting section which connects the divider section and the end section.

10. The cooktop of claim 9, wherein the connecting section is bent such that the end section is angled with respect to the divider section.

11. The cooktop of claim 8, wherein an end section extends into the slit of the bottom of the burner box such that the bottom supports the end section and the divider section, respectively.

* * * * *